US009465313B2

(12) United States Patent
Obayashi et al.

(10) Patent No.: US 9,465,313 B2
(45) Date of Patent: Oct. 11, 2016

(54) OPTICAL PRINT HEAD AND IMAGE FORMING APPARATUS

(71) Applicant: KONICA MINOLTA, INC., Chiyoda-ku, Tokyo (JP)

(72) Inventors: Makoto Obayashi, Toyokawa (JP); Satoshi Masuda, Neyagawa (JP); Yoshikazu Watanabe, Toyohashi (JP); Masayuki Iijima, Okazaki (JP); So Yano, Ibaraki (JP); Takaki Uemura, Seto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/800,803

(22) Filed: Jul. 16, 2015

(65) Prior Publication Data

US 2016/0018755 A1 Jan. 21, 2016

(30) Foreign Application Priority Data

Jul. 18, 2014 (JP) ..... 2014-147545

(51) Int. Cl.
*G03G 15/00* (2006.01)
*G03G 15/04* (2006.01)
*G03G 15/043* (2006.01)

(52) U.S. Cl.
CPC ..... *G03G 15/04054* (2013.01); *G03G 15/043* (2013.01)

(58) Field of Classification Search
CPC ..... G03G 15/221; G03G 15/04072; G03G 15/326; G03G 15/04018
USPC ..... 399/40
See application file for complete search history.

(56) References Cited

U.S. PATENT DOCUMENTS

2004/0066358 A1 4/2004 Numao
2004/0257353 A1* 12/2004 Imamura ..... G09G 3/3233 345/204

(Continued)

FOREIGN PATENT DOCUMENTS

JP 2004-177926 A 6/2004
JP 2005-144685 A 6/2005

(Continued)

OTHER PUBLICATIONS

Notification of Reasons for Refusal dated Jun. 21, 2016 issued in the corresponding Japanese Patent Application No. 2015-142202 and English translation (5 pages).

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

An optical print head includes: light-emitting elements in line shape; first power line supplying first reference voltage; second power line supplying drive current to each light-emitting element and supplying second reference voltage; DAC outputting first voltage indicating light emission amount of each light-emitting element; first elements for holding first voltage difference between the first reference voltage and the first voltage; second elements each electrically connectable with corresponding first element and for holding second voltage difference between the second reference voltage and second voltage according to the first voltage, and during supply of drive current, controls each first element to hold the first difference by electrically disconnecting the first and second elements, and temporarily suspends supply of the drive current, and controls the second element to hold the second difference by electrically connecting the first and second elements, such that the drive current according to the second voltage difference is supplied.

14 Claims, 12 Drawing Sheets

(56) References Cited

U.S. PATENT DOCUMENTS

| | | | | |
|---|---|---|---|---|
| 2005/0146593 | A1 | 7/2005 | Yamazaki et al. | |
| 2008/0012925 | A1 | 1/2008 | Yamazaki et al. | |
| 2009/0141113 | A1 | 6/2009 | Yamazaki et al. | |
| 2011/0164103 | A1* | 7/2011 | Kii | B41J 2/45 347/118 |
| 2012/0062538 | A1 | 3/2012 | Koyama | |
| 2013/0207564 | A1* | 8/2013 | Ota | H05B 37/02 315/224 |
| 2014/0023399 | A1* | 1/2014 | Ohno | B41J 2/45 399/220 |
| 2014/0078233 | A1 | 3/2014 | Yamashita et al. | |

FOREIGN PATENT DOCUMENTS

| | | | |
|---|---|---|---|
| JP | 2005-144686 | A | 6/2005 |
| JP | 2005-144687 | A | 6/2005 |
| JP | 2006-95787 | A | 4/2006 |
| JP | 2012-078816 | A | 4/2012 |
| JP | 2014-062967 | A | 4/2014 |

* cited by examiner

OPTICAL PRINT HEAD AND IMAGE FORMING APPARATUS

CROSS-REFERENCE TO RELATED APPLICATIONS

This application is based on application No. 2014-147545 filed in Japan, the contents of which are hereby incorporated by reference.

BACKGROUND OF THE INVENTION (1) Field of the Invention

The present invention relates to an optical print head (PH) that performs writing onto a photoreceptor by an optical beam and an image forming apparatus including the optical PH.

(2) Related Art

With a recent increase demand for size-reduction of optical PHs that perform writing onto a photoreceptor by an optical beam that are included in image forming apparatuses such as printers, there have been increasingly used optical PHs in which micro dot light-emitting elements are disposed in a line shape.

For example, Patent Literature 1 (Japanese Patent Application Publication No. 2005-144686) discloses an optical PH that has a configuration in which a plurality of light-emitting elements (organic EL elements), a first power line, and a second power line are provided on a first substrate, and a first auxiliary power line and a second auxiliary power line are provided on a second substrate. The light-emitting elements are arranged in a single line. The first power line is a thin-film wire, and is connected with a feeding point on a power source side. The second power line is a thin-film wire, and is connected with a feeding point on a ground side. The first auxiliary power line is electrically connected with the first power line at a plurality of points. The second auxiliary power line is electrically connected with the second power line at a plurality of points.

According to this configuration with an increased number of feeding points, it is possible to suppress voltage variation of the power line from influencing the light-emitting elements. In other words, it is possible to shorten a length from one feeding point to each of the light-emitting elements compared with the case where a less number of feeding points are provided such as a case where no auxiliary power line is provided. This decreases a potential drop due to a wiring resistance. As a result, it is possible to decrease a difference in drive current to be supplied between the light-emitting elements caused by the potential drop, thereby to decrease a difference in light emission amount between the light-emitting elements. This suppresses image unevenness due to the difference in light emission amount.

However, another problem occurs in the configuration disclosed in Patent Literature 1. Specifically, in order to provide an auxiliary power line, it is necessary to provide a wiring on a sealing plate protecting the light-emitting elements and provide a mechanism for electrically connecting the auxiliary power line with each of power lines. This complicates a wiring configuration and requires a high manufacturing cost.

Also, even if the configuration is adopted in which a certain increased number of power feeding points are provided as in the configuration disclosed in Patent Literature 1, a potential drop still occurs on a part of a power line between each two adjacent power feeding points in a direction in which current flows from the power line. Accordingly, a problem still remains that unevenness in light emission amount due to the potential drop is not sufficiently eliminated.

Also, there has been considered a method according to which, in a single line period in which single line writing is performed onto a photoreceptor by an optical beam, occurrence of a potential drop is prevented by suspending supply of a drive current to all the light-emitting elements to turn off all the light-emitting elements while luminance signals each indicating one of the light-emitting elements are sequentially held in holding elements provided in one-to-one correspondence with the light-emitting elements. However, another problem is caused by the above method. Specifically, the method increases a period in which the light-emitting elements are turned off, and as a result decreases a light emission duty ratio that is a ratio of the light emission period of the light-emitting elements in a main scanning period (Hsync). Therefore, it is necessary to increase a light emission amount of the light-emitting elements in order to a sufficient exposure amount in a short light emission period. This results in a short operating life of the light-emitting elements.

The present invention was made in view of the above problems, and aims to provide an optical PH that is capable of suppressing unevenness in light emission amount between light-emitting elements due to a potential drop on a power line caused by a current flowing through the light-emitting elements from the power line and increasing the light emission duty ratio, and an image forming apparatus that includes the optical PH.

SUMMARY OF THE INVENTION

In order to solve the above problem, the present invention provides an optical print head comprising: a plurality of current-driven light-emitting elements that are disposed in a line shape; a first power line that supplies a first reference voltage; a second power line that supplies a drive current to each of the light-emitting elements, and supplies a second reference voltage; a first voltage output unit that outputs, with respect to each of the light-emitting elements, a first voltage indicating a light emission amount of the light-emitting element; a plurality of first holding elements that are provided in one-to-one correspondence with the light-emitting elements, and are each for holding therein a first voltage difference between the first reference voltage and the first voltage; a plurality of second holding elements that are provided in one-to-one correspondence with the light-emitting elements, are each electrically connectable with a corresponding one of the first holding elements, and are each for holding therein a second voltage difference between the second reference voltage and a second voltage, the second voltage being according to the first voltage; and a control unit that successively performs a first holding operation and a second holding operation in a main scanning period, wherein the first holding operation is an operation that, during supply of the drive current to each of the light-emitting elements, with respect to each of the light-emitting elements, controls a corresponding one of the first holding elements to hold therein the first voltage difference by electrically disconnecting the corresponding first holding element from a corresponding one of the second holding elements, and the second holding operation is an operation that temporarily suspends supply of the drive current to the light-emitting element, and controls the second holding element to hold therein the second voltage difference by electrically connecting the first holding element with the second holding element, such that the drive current according to the second voltage difference is supplied to the light-emitting element after supply of the drive current is resumed.

BRIEF DESCRIPTION OF THE DRAWINGS

These and other objects, advantages and features of the invention will become apparent from the following description thereof taken in conjunction with the accompanying drawings those illustrate a specific embodiment of the invention.

In the drawings.

DESCRIPTION OF PREFERRED EMBODIMENT

The following explains an embodiment of an optical PH and an image forming apparatus relating to the present invention with use of an example of a tandem-type color printer (hereinafter, referred to simply as a printer).

Embodiment

(1) Configuration of Printer 1A

Figure 1:
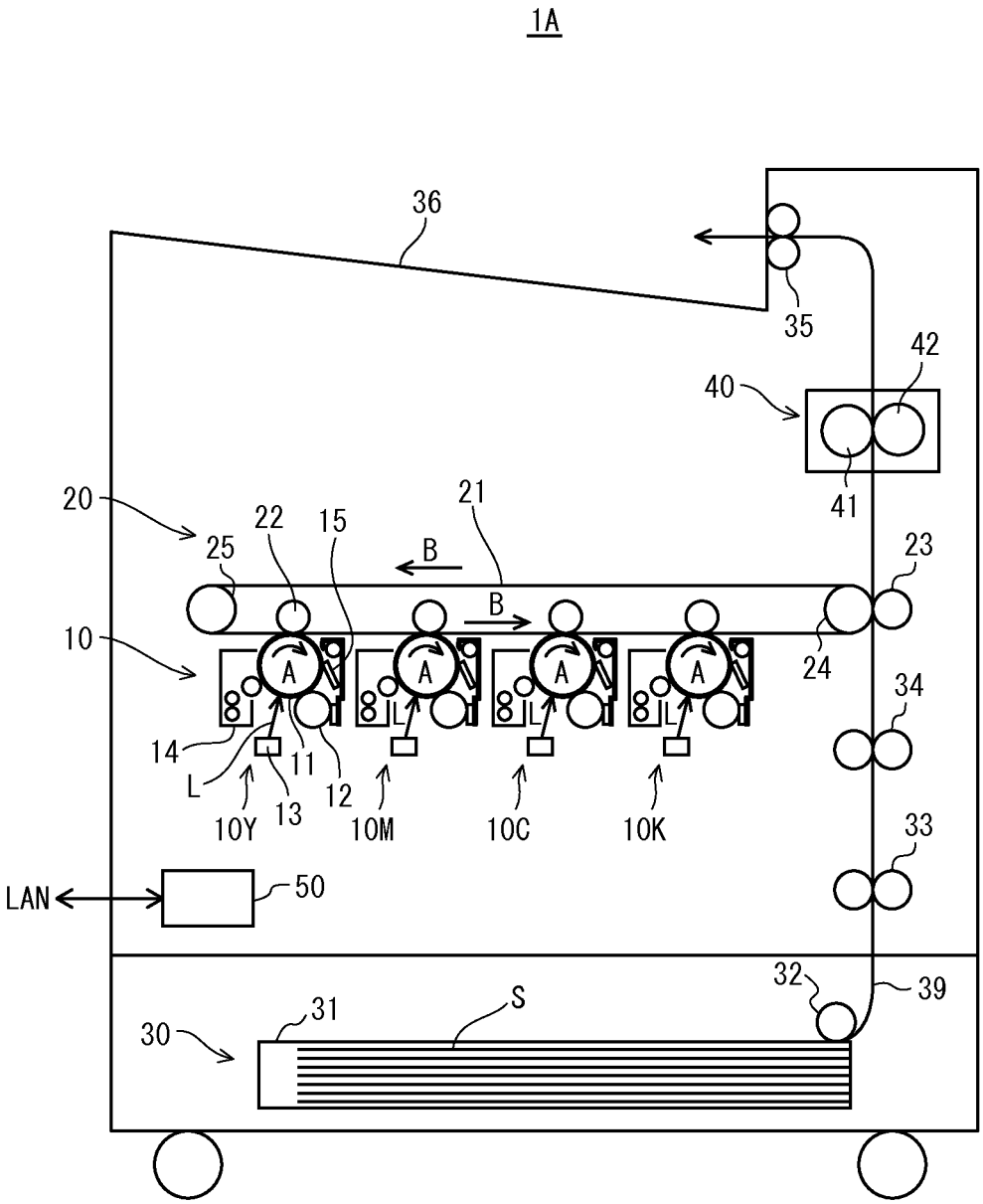
FIG. 1 shows the overall configuration of a printer 1A.

FIG. 1 shows the overall configuration of a printer 1A relating to the present embodiment. As shown in the figure, the printer 1A forms images by an electronic photography system, and includes an image process unit 10, a sheet feeding unit 30, a fixing unit 40, and a control unit 50.

The printer 1A is connected with a network such as LAN to receive a print instruction from an external terminal device (not illustrated) or an operation panel including a display unit (not illustrated). Upon receipt of such a print instruction, the printer 1A forms respective toner images of yellow, magenta, cyan, and black colors, and sequentially multi-transfers the toner images to a recording sheet, such that a full-color image is formed on the recording sheet to complete a print operation. In the following description, the reproduction colors of yellow, magenta, cyan, and black are denoted as Y, M, C and K, respectively, and any compositional element related to one of the reproduction colors is denoted by a reference sign attached with an appropriate subscript Y, M, C or K.

The image process unit 10 includes image forming subunits 10Y, 10M, 10C, and 10K, an intermediate transfer belt 21, a secondary transfer roller 23, and so on. Since the image forming subunits 10Y, 10M, 10C, and 10K all have the same configurations, the following explanation is given mainly on the configuration of the image forming subunit 10Y.

The image forming subunit 10Y includes a photoconductive drum 11 and also includes a charger 12, an optical PH 13, a developer 14, a cleaner 15, and so on, which are disposed about the photoconductive drum 11. The cleaner 15 is provided for cleaning the photoconductive drum 11. The image forming subunit 10Y forms a Y-color toner image on the photoconductive drum 11. The charging unit 12 charges a circumferential surface of the photosensitive drum 11 that rotates in a direction indicated by an arrow A.

The optical PH 13 exposes the charged photosensitive drum 11 by an optical beam L to form an electrostatic latent image on the photosensitive drum 11. The optical PH 13 includes a plurality of current-driven organic EL elements (organic light-emitting diodes (OLEDs) as light-emitting elements that are arranged in a main scanning direction, as described later. A light emission amount of each of the organic EL elements is controlled based on image data for a print operation that is output by the control unit 50.

The developer 14 is disposed to face the photoconductive drum 11, and carries charged toner particles to the photoconductive drum 11. The intermediate transfer belt 21 is an endless belt wound around a driving roller 24 and a driven roller 25 in taut condition to circularly run in a direction indicated by an arrow B. The electrostatic latent image formed on the photoconductive drum of each color is developed by the developer of a corresponding one of the image forming subunits 10Y, 10M, 10C, and 10K, such that a toner image (unfixed image) of a corresponding color is formed on the photoconductive drum.

The toner images thus formed are sequentially transferred in accordance with an appropriately adjusted timing by the respective primary transfer rollers of the image forming subunits 10Y, 10M, 10C, and 10K (in FIG. 1, only the primary transfer roller of the image forming subunit 10Y bears the reference sign 22, whereas the reference signs of the other primary transfer rollers are omitted) in the process of primary transfer, such that the toner images are layered at the same position on the intermediate transfer belt 21. Then, in the process of secondary transfer, the toner images layered on the intermediate transfer belt 21 are transferred all at once onto a recording sheet by the action of the electrostatic force imposed by the secondary transfer roller 23.

The sheet feeding unit 30 includes a sheet feeding cassette 31 for storing recording sheets (denoted by reference sign S), a pickup roller 32 that picks up recording sheets S from the sheet feeding cassette 31 one sheet at a time and feeds the recording sheet S onto a conveyance path 39, and a pair of conveyance rollers 33 and 34 that transport the picked-up recording sheet S.

The fixing device 40 includes a heating roller 41 and a pressure roller 42 that presses the heating roller 41. The fixing device 40 heats and presses the recording sheet having the toner images secondarily transferred thereon to thermally fix the toner images onto the recording sheet.

The control unit 50 is a so-called computer that is composed of a central processing unit (CPU), a read only memory (ROM), a random access memory (RAM), and so on to control the whole print operation. The control unit 50 includes an application specific integrated circuit (ASIC) (hereinafter, referred to as a luminance signal output subunit). Upon receiving a print job for example, the luminance signal output unit included in the control unit 50 generates, based on image data for a print operation included in the print job, a digital luminance signal indicating a light emission amount of each of a plurality of organic EL elements arranged in the optical PH 13 included in each of the image forming subunits 10Y, 10M, 10C, and 10K.

(2) Configuration of Optical PH

Figure 2:
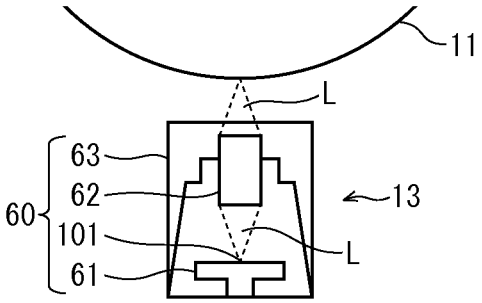
FIG. 2 shows a configuration of an optical PH 13.

FIG. 2 shows a configuration of the optical PH 13. The optical PH 13 includes an OLED panel 61 and a rod lens array 62 that are housed in a housing 63. A plurality of organic EL elements 101 are arranged on the OLED panel 61 in a line shape in the main scanning direction (direction perpendicular to a paper surface of the figure).

The organic EL elements 101 each emit an optical beam L separately. The rod lens array 62 causes the optical beam L, which is emitted from each of the organic EL elements 101, to form an image on a surface of the photosensitive drum 11.

Figure 3:
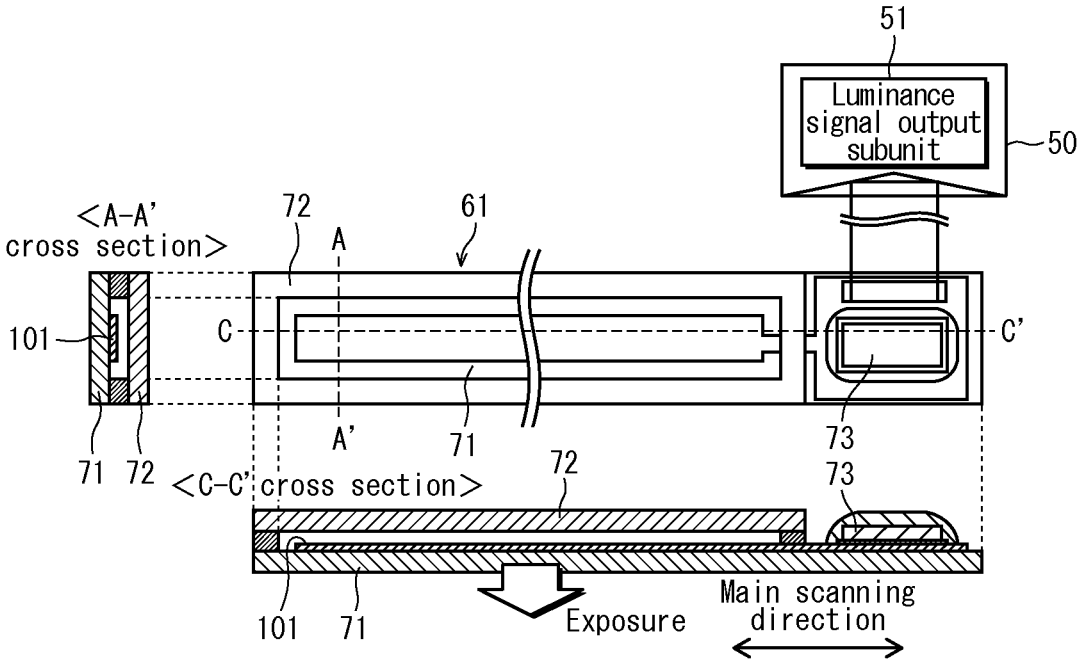
FIG. 3 is a schematic plan view and cross-sectional views showing an OLED panel 61.

FIG. 3 is a schematic plan view showing the OLED panel 61, including a cross-sectional view taken along line A-A' and a cross-sectional view taken along line C-C'. As shown in the figure, the OLED panel 61 includes a thin film transistor (TFT) substrate 71 on which the organic EL elements 101 are unified, a sealing plate 72, and a source IC 73. The TFT substrate 71 has the organic EL elements 101 arranged thereon in the main scanning direction. For each of the organic EL elements 101, a drive circuit, two types of holding elements, a discharge circuit, and so on are provided, which are described later.

The sealing plate 72 is provided for sealing a region where the organic EL elements 101 are disposed on the TFT substrate 71 so as not to be exposed to ambient air.

As shown in the figure, the source IC 73 is mounted on a region on the TFT substrate 71 other than a region where the sealing plate 72 is disposed, and includes a plurality of digital/analog converters (hereinafter, referred to as DACs), a shift register, and so on. The DACs each convert a digital luminance signal, which is output from the luminance signal output subunit 51 included in the control unit 50, to a luminance signal represented by an analog voltage indicating a light emission amount of a corresponding one of the organic EL elements 101.

Figure 4:
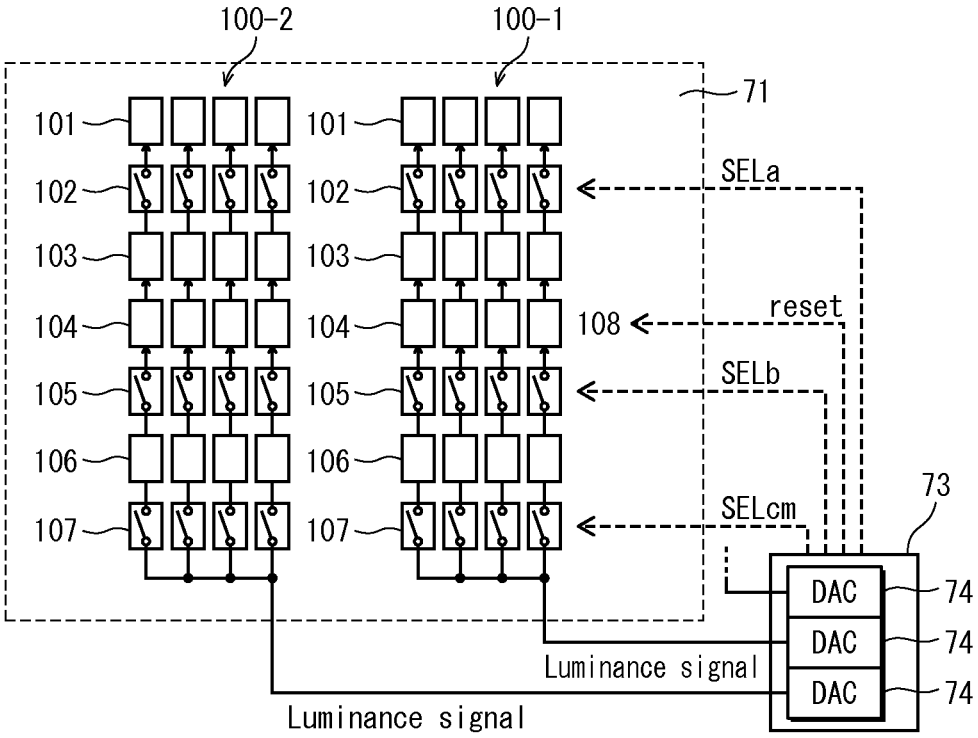
FIG. 4 schematically shows a relation between a source IC 73 and compositional elements of light-emitting circuits provided on a TFT substrate 71 that are controlled by the source IC 73.

FIG. 4 schematically shows a relation between the source IC 73 and compositional elements of light-emitting circuits provided on the TFT substrate 71 that are controlled by the source IC 73. In the figure, light-emitting circuits 100-1 and 100-2 each correspond to a different one of the DACs 74 included in the source IC 73.

The light-emitting circuits 100-1 and 100-2 are each composed of a plurality of dot circuits. Although four dot circuits are used here for convenience of explanation, the number of dot circuits is of course not limited to four. The dot circuits each include the organic EL element 101, an interrupt switch 102, a drive circuit 103, a second holding element 104 constituting a sample/hold (S/H) circuit, a holding element connection switch 105, a first holding element 106, a DAC connection switch 107, a discharge circuit 108, and so on.

The first holding element 106 and the second holding element 104 each may be a capacitor for example. Also, the discharge circuit 108 is provided for each of the second holding elements 104, as described later. In the figure, for convenience of explanation, only one of the discharge circuits 108 included in the light-emitting circuit 100-1 is represented by reference sign, whereas the other three discharge circuits 108 are omitted, and the four discharge circuits 108 included in the light-emitting circuit 100-2 are all omitted.

The interrupt switch 102 is a switch that interrupts supply of a drive current for driving the organic EL element 101. Also, the first holding element 106 holds therein a voltage difference between a reference voltage supplied from a power line 92, which is shown in FIG. 5 to FIG. 9 described later (hereinafter, referred to as a first reference voltage) and a voltage representing a luminance signal output by the DAC 74 (hereinafter, referred to as a first voltage).

The holding element connection switch 105 is a switch that switches between electrical connection and disconnection between the first holding element 106 and the second holding element 104. The DAC connection switch 107 is a switch that switches electrical connection and disconnection between the first holding element 106 and the DAC 74.

Furthermore, the discharge circuit 108 is a circuit that is electrically connected with the second holding element 104, and discharges a charge held in the second holding element 104. The discharge circuit 108 includes a selector switch 1081 that switches electrical connection with and disconnection from the second holding element 104 and a resistance element 1082.

The source IC 73 controls switch between on and off of each of the above switches by outputting a control signal. Specifically, the source IC 73 switches the DAC connection switch 107, the holding element connection switch 105, the selector switch 1081 of the switch discharge circuit 108, and the interrupt switch 102 by outputting control signals SELcm, SELb, reset, and SELa, respectively. In the figure, the control signals are illustrated only with respect to the light-emitting circuit 100-1, whereas the control signals are omitted with respect to the light-emitting circuit 100-2.

Each of the DACs 74, which corresponds to every plural dot circuits constituting each of the light-emitting circuits, successively outputs the first voltage to the respective first holding elements 106 included in the dot circuits. Specifically, the source IC 73 controls the DAC connection switch 107 to successively select one by one the first holding elements 106 which are to be connected with the DAC 74 to output the first voltage from the DAC 74 to the selected first holding element 106 and hold a voltage difference between the first reference voltage and the first voltage in the selected first holding element 106.

Also, the source IC 73 controls the interrupt switch 102, the holding element connection switch 105, the DAC connection switch 107, which are included in each of the dot circuits to electrically disconnect the DAC 74 from the first holding element 106 and electrically disconnect the organic EL element 101 from the drive circuit 103. Also, the source IC 73 electrically connects the first holding element 106 with the second holding element 104. In such a state, the source IC 73 controls the second holding element 104 to hold therein a voltage difference between a reference voltage supplied from the power line 91 which is shown in FIG. 5 to FIG. 9 described later (hereinafter, referred to as a second reference voltage) and a voltage according to the first voltage (hereinafter, referred to as a second voltage). Then, the source IC 73 electrically connects the organic EL element 101 with the drive circuit 103, and supplies the drive current according to the voltage difference between the second reference voltage and the second voltage, from the drive circuit 103 to the organic EL element 101. As a result, the organic EL element 101 is turned on.

Before electrically connecting the first holding element 106 with the second holding element 104, the source IC 73 outputs a control signal reset to switch on the selector switch 1081 of the discharge circuit 108 to electrically connect the second holding element 104 with the discharge circuit 108, and discharges the charge held in the second holding element 108.

Figure 5:
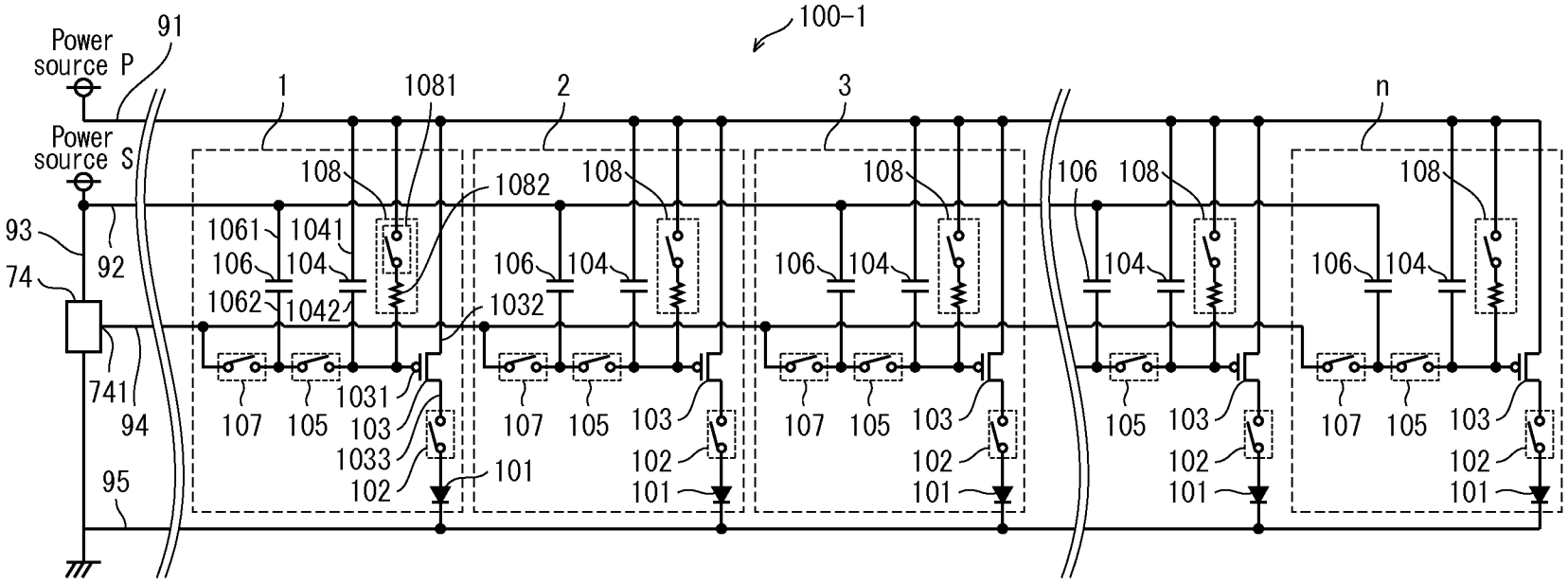
FIG. 5 shows a circuit configuration of a light-emitting circuit 100-1 corresponding to one of DACs 74.

FIG. 5 shows a circuit configuration of the light-emitting circuit 100-1 corresponding to one of the DACs 74. As shown in the figure, the light-emitting circuit 100-1 is composed of a plurality of dot circuits (n dot circuits here) 1 through n. The dot circuits 1 through n each include the organic EL element 101, the interrupt switch 102, the drive circuit 103, the second holding element 104, the holding element connection switch 105, the first holding element 106, the DAC connection switch 107, and the discharge circuit 108. In the figure, reference signs are appended to all the compositional elements only with respect to the dot circuit 1, whereas reference signs are not appended to part of the compositional elements with respect to the other dot circuits.

The organic EL elements (n organic EL elements) 101, which are included in the respective dot circuits 1 through n, are disposed in a line shape in the main scanning direction between a power line 91 and a cathode electrode line 95 and in parallel with the power line 91 and the cathode electrode line 95. The power line 91 extends from a constant-voltage power source P in the main scanning direction. The cathode electrode line 95 is an earth line. The following explains a connection relation between the compositional elements of each of all the dot circuits.

The drive circuit 103 and the interrupt switch 102 are arranged in this order on a circuit that is configured starting with the power line 91 to reach the organic EL element 101. The DAC 74 is disposed between the power line 92 and the cathode electrode line 95. The power line 92 extends from a constant-voltage power source S in the main light direction. The DAC 74 operates according to a voltage that is supplied from a power line 93, and outputs the first voltage to a signal line 94. The power line 93 extends from the power source S, and the signal line 94 extends from an output terminal 741 of the DAC 74 in the main scanning direction.

One of connection terminals of each of the first holding elements 106, namely a connection terminal 1061 is connected with the power line 92 that supplies the first reference voltage. One of connection terminals of each of the second holding elements 104, namely a connection terminal 1041 is connected with the power line 91 that supplies the second reference voltage. The power line 94 is connected, at a plurality of different positions, with one of contacts (contact on the left side) of each of the respective DAC connection switches 107 included in all the dot circuits. The other contact (contact on the right side) of each of the DAC connection switches 107 is connected with the other contact of the corresponding first holding element 106, namely a connection terminal 1062 and one of contacts (contact on the left) of the corresponding holding element connection switch 105.

Also, the other contact (contact on the right side) of each of the holding element connection switches 105 is connected to the connection terminal 1042 of the corresponding second holding element 104 and a gate terminal 1031 of the corresponding drive circuit 103.

The drive circuits 103 are each a voltage input type drive circuit that includes a gate terminal 1031, an input terminal 1032, and an output terminal 1033. The drive circuit 103 is for example a P-type field effect transistor (FET) here, and the input terminal 1032 corresponds to a source, and the output terminal 1033 corresponds to a drain.

In each of the discharge circuits 108, one of contacts (contact on the upper side) of the selector switch 1081 is connected with the connection terminal 1041 of the corresponding second holding element 104, and the other contact (contact on the side of the resistance element 1082) of the selector switch 1081 is connected with the connection terminal 1042 of the second holding element 104.

FIG. 6 to FIG. 9 show variation in connection status of a dot circuit in a single main scanning period (period from when a first holding operation starts with respect to the top dot circuit in which a voltage difference between the first reference voltage and the first voltage is held to when the second holding operation completes with respect to all the dot circuits in which a voltage difference between the second reference voltage and the second voltage is held). For the purpose of comparison with FIG. 5, FIG. 6 to FIG. 9 each have reference signs appended thereto that are the same as those appended to the compositional elements of the dot circuit shown in FIG. 5.

Figure 6:
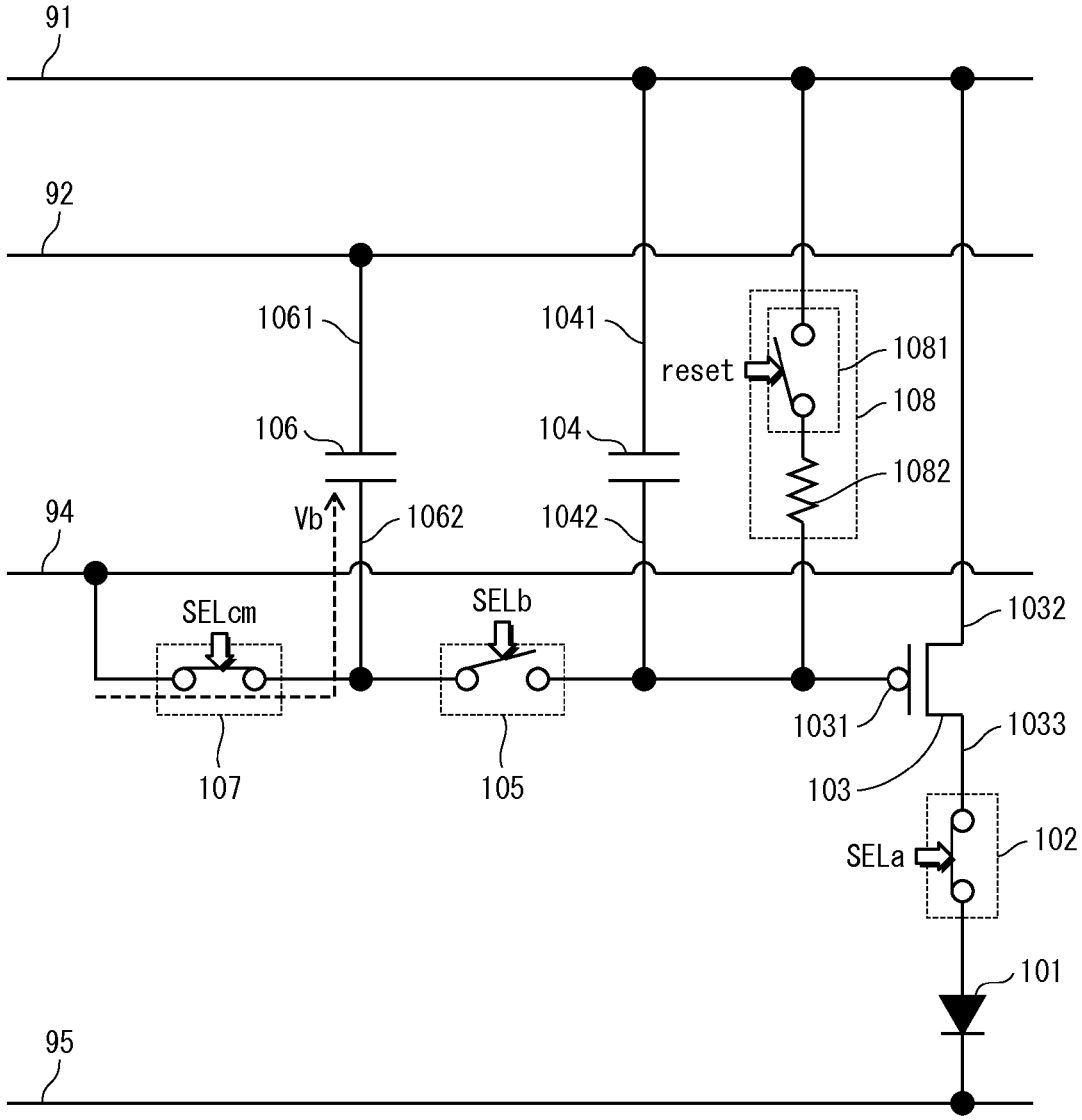
FIG. 6 shows a connection status of a dot circuit m in a sample period.

FIG. 6 shows a connection status of a dot circuit (the dot circuit m that is included in the light-emitting circuit 100-1, where $1 \leq m \leq n$, and m and n are each an integer) in a period in which the voltage difference between the first reference voltage and the first voltage which is output to the signal line 94 is held in the dot circuit m. This period is hereinafter referred to as a sample period. The sample period starts with respect to each of the dot circuits included in each of the light-emitting circuits in accordance with a different timing.

In other words, while the first holding operation of holding the voltage difference between the first reference voltage and the first voltage is performed in any one of the dot circuits, the first holding operation is not performed in the remainder of the dot circuits. As shown in the figure, control is performed in the sample period such that the DAC connection switch 107 is on (conductive), the holding element connection switch 105 is off (non-conductive), the selector switch 1081 of the discharge circuit 108 is off (non-conductive), and the interrupt switch 102 is on (conductive) by the source IC 73 outputting control signals SELcm (subscript m represents the dot circuit m, and the control signal SELcm represents a control signal for the dot circuit m), SELb, reset, and SELa, respectively.

Here, the respective DAC connection switches 107, which are included in the remainder of the dot circuits constituting the light-emitting circuit 100-1, are controlled to be off (non-conductive).

As a result, while a drive current that is according to the voltage difference between the second reference voltage and the second voltage which are held in the second holding element 104 in an immediately previous main scanning period is supplied from the power line 91 to the organic EL element 101 (while the organic EL element 101 is turned on), the voltage difference between the first reference voltage and the first voltage (indicated by reference sign Vb) is held in the first holding element 106.

Here, the first reference voltage that is a reference for obtaining a difference from the first voltage is supplied to the first holding element 106 from the power line 92, which is different from the power line 91 which supplies the drive current. Accordingly, it is possible to hold the voltage difference between the first reference voltage and the first voltage in the first holding element 106 with no influence of a potential drop due to the drive current flowing through the organic EL element 101.

In the first holding operation, a circuit is configured starting from the signal line 94 to reach the power line 92 via the DAC connection switch 107 and the first holding element 106. A current, which corresponds to a voltage difference between the both ends of the first holding element 106, can flow through the first holding element 106. At this time, there is a case where a potential drop can temporarily occur on the power line 92 due to a wiring resistance. However, after charging and discharging of a charge into the first holding element 106 completes, the current does not flow through the first holding element 106 anymore. As a result, the potential drop on the power line 92 ceases. Therefore, a uniform reference voltage is supplied from the power line 92 to the respective first holding elements 106 included in all the dot circuits.

A period, in which the voltage difference between the first reference voltage and the first voltage is held in the first holding element 106, is hereinafter referred to as a first hold period. Specifically, the first hold period starts when the voltage difference between the first reference voltage and the first voltage is held in the first holding element 106, and ends when a charge period, which is described later, starts in which the voltage difference between the second reference voltage and the second voltage is held in the second holding element 104.

Figure 7:
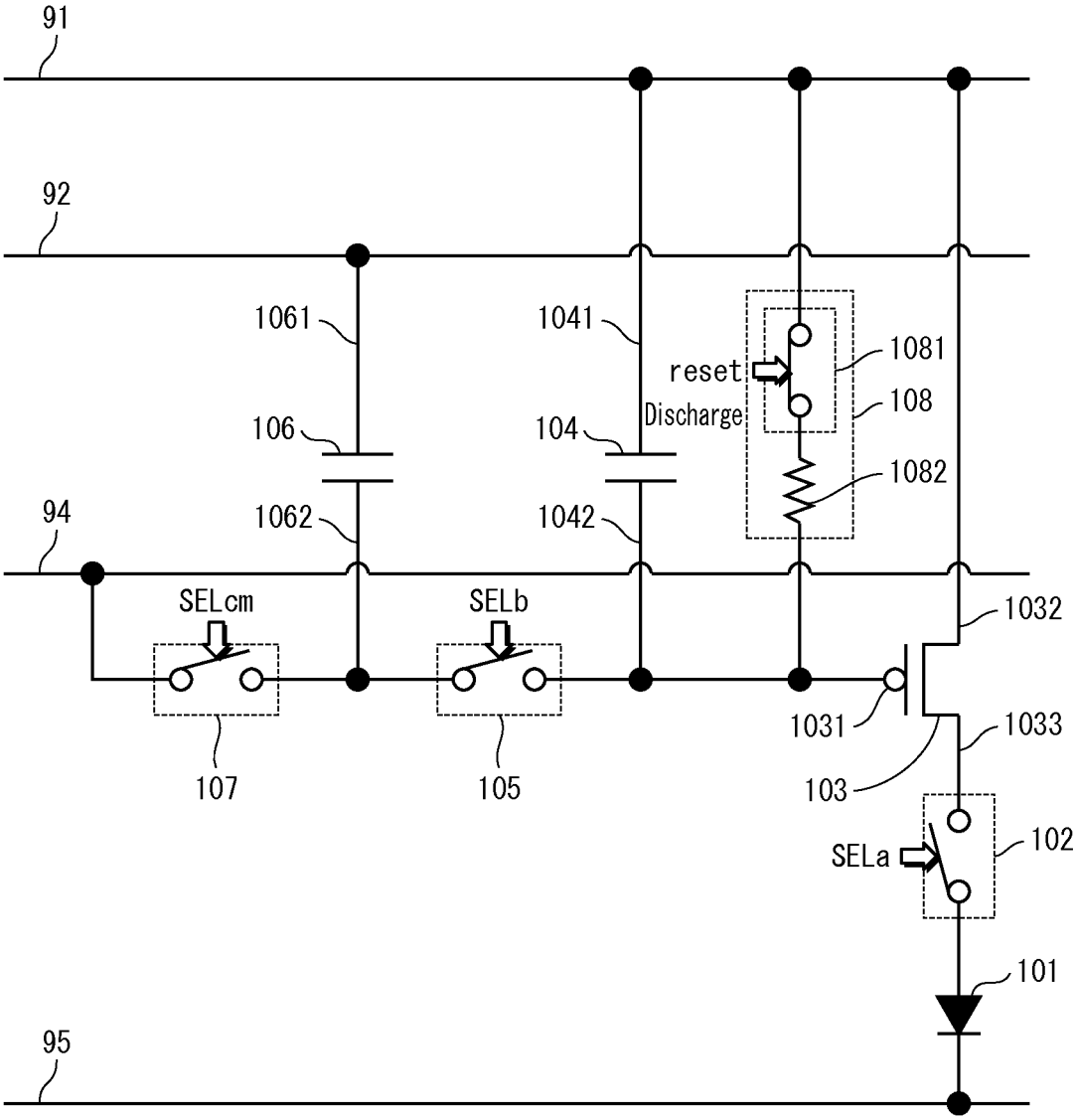
FIG. 7 shows the connection status of the dot circuit m in a discharge period.

FIG. 7 shows the connection status of the dot circuit m in a discharge period after elapse of the sample period in all the dot circuits. In the discharge period, a charge corresponding to the voltage difference between the second reference voltage and the second voltage is discharged, which is held in the second holding element 104 (which has been held in the charge period which is described later, in an immediately previous main scanning period). As shown in the figure, control is performed on each of all the dot circuits in the discharge period such that the DAC connection switch 107 is off (non-conductive), the holding element connection switch 105 is off (non-conductive), the selector switch 1081 of the discharge circuit 108 is on (conductive), and the interrupt switch 102 is off (non-conductive) by the source IC 73 outputting the control signals SELcm, SELb, reset, and SELa, respectively.

As a result, supply of the drive current to each of the organic EL elements 101 is temporarily suspended (the organic EL elements 101 are temporarily turned off), and thus the charge held in each of all the second holding elements 104 is discharged.

Figure 8:
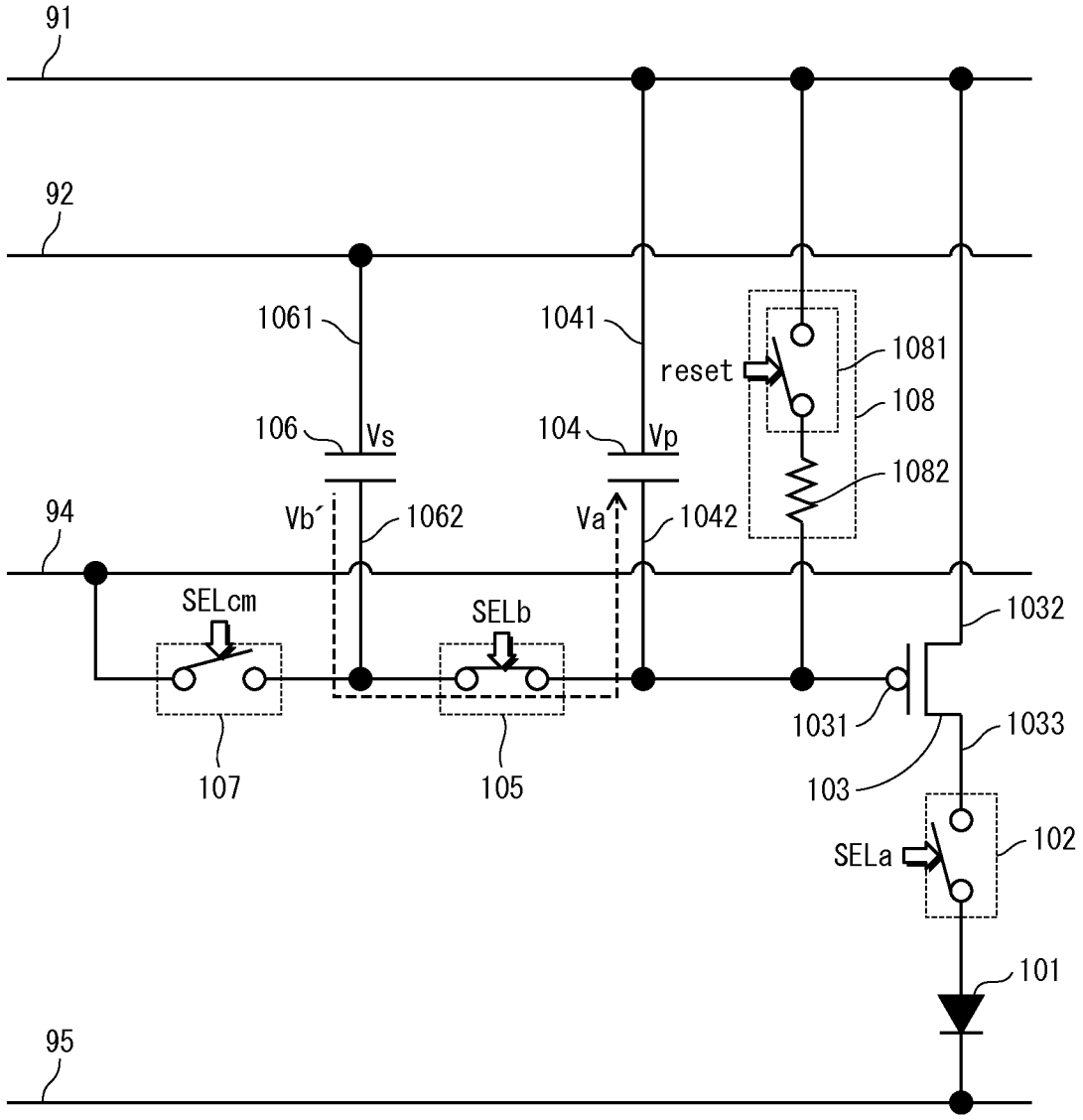
FIG. 8 shows the connection status of the dot circuit m in a charge period.

FIG. 8 shows the connection status of the dot circuit m in a period in which a voltage difference between the second reference voltage and the second voltage is held in each of the respective second holding elements 104 included in the dot circuits 1 through n (hereinafter, referred to as a charge period).

Control is performed on each of all the dot circuits in the charge period such that the DAC connection switch 107 is off (non-conductive), the holding element connection switch 105 is on (conductive), the selector switch 1081 of the discharge circuit 108 is off (non-conductive), and the interrupt switch 102 is off (non-conductive) by the source IC 73 outputting the control signals SELcm, SELb, reset, and SELa, respectively.

As a result, while supply of the drive current to each of the organic EL elements 101 is temporarily suspended (the organic EL elements 101 are temporarily turned off), the first holding elements 106 are each electrically connected with the corresponding second holding element 104. Accordingly, the voltage difference between the second reference voltage and the second voltage Va is held in the second holding element 104 as a voltage for controlling a drive current amount to be supplied to the corresponding organic EL element 101.

Note that a period in which the organic EL elements 101 are temporarily turned off such as described above is hereinafter referred to as a non-emission period.

Also, since control is performed on each of all the dot circuits in the charge period such that the interrupt switch 102 and the selector switch 1081 of the discharge circuit 108 are each off (non-conductive), the current does not flow through the organic EL elements 101 and all the discharge circuits 108 from the power line 91 anymore. Furthermore, after charging and discharging of the charge into the second holding element 104 completes, the current does not flow through the second holding element 104 anymore. As a result, the potential drop hardly occurs on the power line 91. Therefore, a uniform second reference voltage is supplied from the power line 91 to the respective second holding element 104 included in the dot circuits.

The voltage difference between the connection terminals 1061 and 1062 of each of the first holding elements 106 is equal to the voltage difference between the connection terminals 1041 and 1042 of the corresponding second holding element 104 while the first holding element 106 is electrically connected with the second holding element 104. Therefore, the following relation is satisfied, where the first voltage output to the first holding element 106 is expressed by Vb, a potential of the connection terminal 1042 of the second holding element while the first holding element 106 is electrically connected with the second holding element 104 is expressed by Va (second voltage), a potential of the power source P is expressed by Vp, and a potential of the power source S is expressed by Vs.

$$Vp-Va=Vs-Vb' \tag{1}$$

(Vb' expresses a potential of the connection terminal 1062 of the first holding element 106 while the first holding element 106 is electrically connected with the second holding element 104.)

Also, the following relation is satisfied according to the charge conservation law, where an electrostatic capacitance of the first holding element 106 is expressed by Cb and an electrostatic capacitance of the second holding element 104 is expressed by Ca.

$$Cb\times(Vs-Vb)=Ca\times(Vp-Va)+Cb\times(Vs-Vb') \tag{2}$$

The following relation between the second voltage Va and the first voltage Vb is obtained with use of the formulas (1) and (2).

$$Va=1/(1+Ca/Cb)\times(Vb+(Vp-Vs)) \tag{3}$$

Since the electrostatic capacitance Ca, the electrostatic capacitance Cb, the potential Vp, and the potential Vs are fixed values, the second voltage Va varies according to the first voltage Vb as shown in the formula (3). Accordingly, the drive current amount to be supplied to each of the organic EL elements 101 is controlled according to the first voltage Vb by holding the voltage difference between the second reference voltage and the second voltage Va in the corresponding second holding element 104.

A period in which the voltage difference between the second reference voltage and the second voltage is held in the second holding element 104 is hereinafter referred to as a second hold period. Specifically, the second hold period starts when the voltage difference is held in the second holding element 106, and ends when a subsequent discharge period starts.

Figure 9:
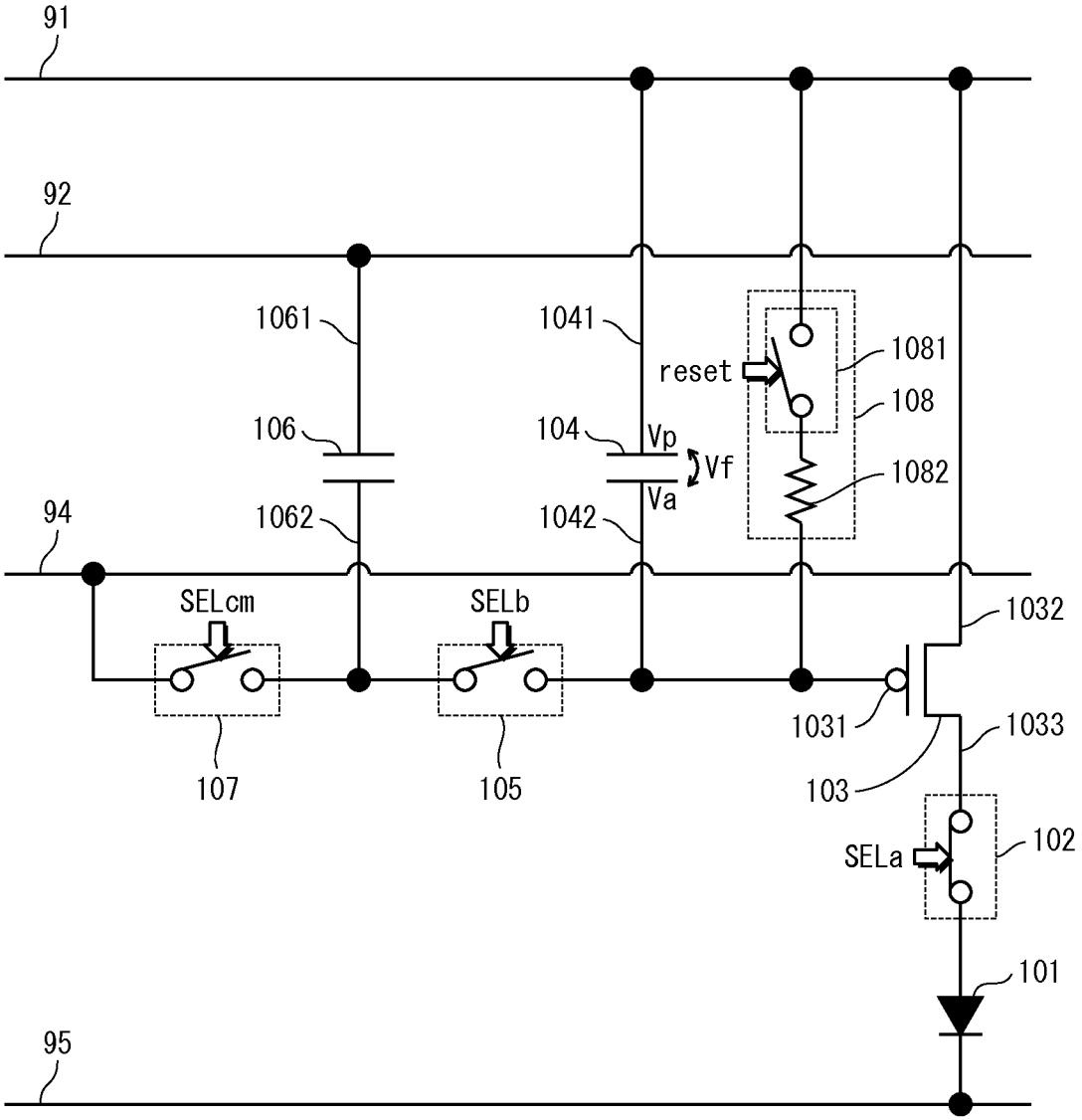
FIG. 9 shows the connection status of the dot circuit m at a time when a sample period in a subsequent main scanning period (Hsync) starts in a dot circuit 1 after lapse of the charge period.

FIG. 9 shows the connection status of the dot circuit m (here, m is an integer that satisfies 1≤m≤n) at a time when a sample period in the subsequent main scanning period starts in the dot circuit 1 after lapse of the charge period. As shown in the figure, control is performed on the dot circuit m such that the DAC connection switch 107 is off (non-conductive), the holding element connection switch 105 is off (non-conductive), the selector switch 1081 of the discharge circuit 108 is off (non-conductive), and the interrupt switch 102 is on (conductive) by the source IC 73 outputting the control signals SELcm, SELb, reset, and SELa, respectively.

As a result, the drive current is supplied to the organic EL element 101 while a charge, which corresponds to a voltage difference Vf that is a difference between the second reference voltage Vp and the second voltage Va, is held in the second holding element 104. Therefore, the potential difference between the input terminal 1032 and the gate terminal 1031 of the drive circuit 103 is maintained to the voltage difference Vf during supply of the drive current.

A drive current according to the potential difference between the input terminal 1032 and the gate terminal 1031 is supplied from the drive circuit 103 to the organic EL element 101. Accordingly, it is possible to supply a uniform drive current (drive current according to the voltage difference Vf) to the organic EL element 101 by maintaining the potential difference to the voltage difference Vf. The same applies to the dot circuits other than the dot circuit m.

Specifically, even when the drive current is supplied from the power line 91 to the organic EL element 101 and the potential of the input terminal 1032 of the drive circuit 103 decreases due to the potential drop on the power line 91, the potential difference between the input terminal 1032 and the gate terminal 1031 is maintained to the voltage difference Vf. Accordingly, the potential of the gate terminal 1031 decreases by the potential decrease of the input terminal 1032, and as a result the drive current amount to be supplied to the organic EL element 101 does not vary depending on the connection position with driving circuit 103 on the power line 91.

Therefore, although the connection position differs between the dot circuits, it is possible to turn on the respective organic EL elements 101 included in the dot circuits with a uniform light emission amount while the organic EL elements 101 are all turned on.

Note that a period in which the organic EL elements 101 are turned on is hereinafter referred to as an emission period. Specifically, in the emission period, the drive current is supplied to the organic EL elements 101 and thus the organic EL elements 101 are turned on while the voltage difference between the second reference voltage and the second voltage is held in the second holding element 104 in the second hold period.

Figure 10:
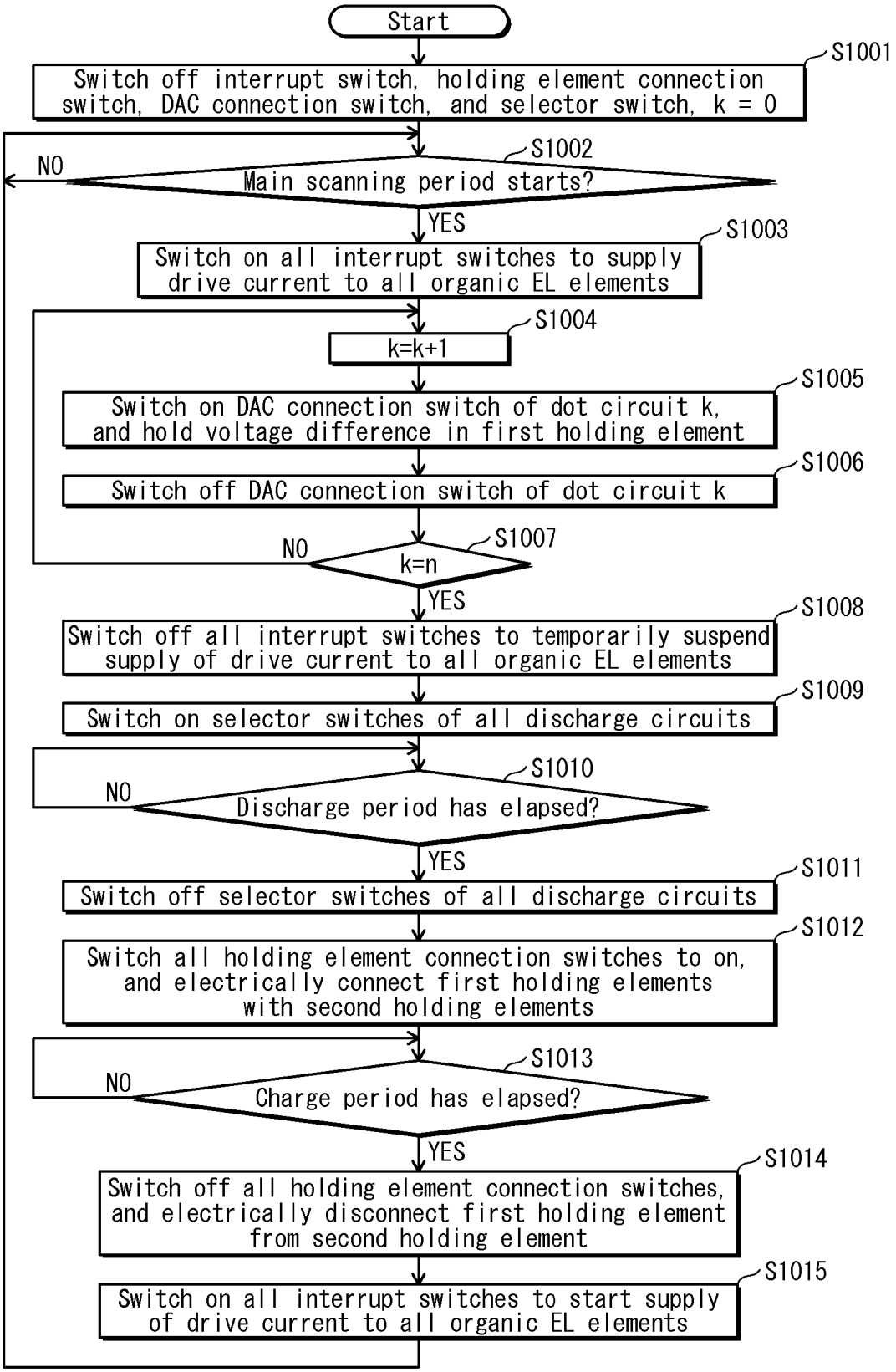
FIG. 10 shows operations of control processing performed on the light-emitting circuits in the main scanning period (Hsync) by the source IC 73 outputting control signals.
Figure 11:
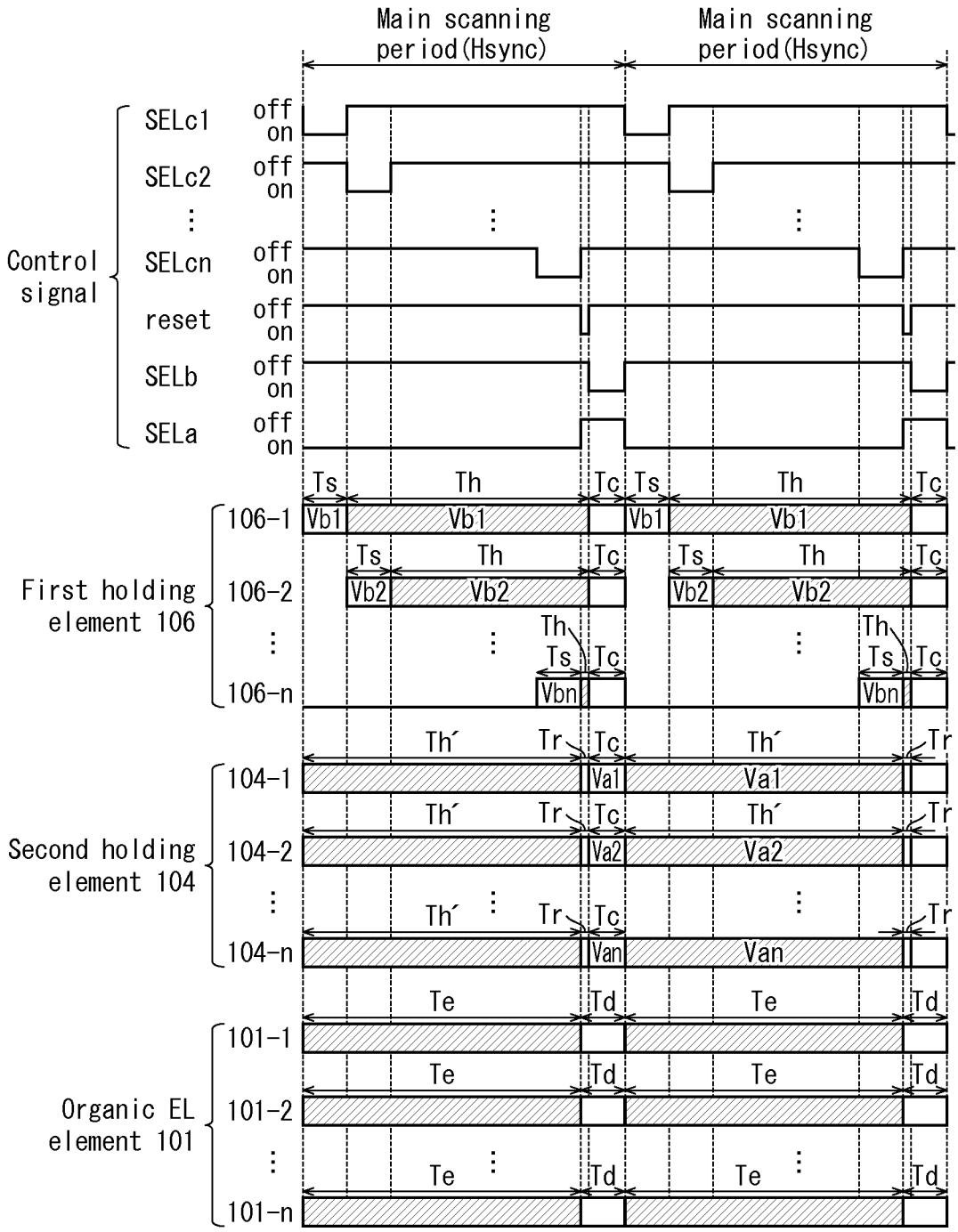
FIG. 11 is a time chart showing temporal variation in the main scanning period (Hsync) with respect to a control status by the control signals, a holding status of a voltage difference between a first reference voltage and a first voltage, a holding status of a voltage difference between a second reference voltage and a second holding element, and an on/off status of an organic EL element.

FIG. 10 shows control processing performed on the light-emitting circuits in the main scanning period (Hsync) by the source IC 73 outputting the control signals. FIG. 11 is a time chart showing temporal variation in the main scanning period (Hsync) with respect to a control status by the control signals, a holding status of the voltage difference between the first reference voltage and the first voltage in the first holding element 106, a holding status of the voltage difference between the second reference voltage and the second voltage in the second holding element 104, and an on/off status of the organic EL element 101. In FIG. 11, the respective names of the control signal SELc, the first holding element 106, the second holding element 104, and the organic EL element 101 each have, at the end thereof, the numbers 1 through n each indicating a corresponding dot circuit (hereinafter, referred to as a dot circuit number). The following explains the operations with reference to FIG. 10 and FIG. 11.

The source IC 73 switches off (to non-conductive) the respective interrupt switches 102, the respective holding element connection switches 105, the respective DAC connection switches 107, and the respective selector switches 1081 of the respective discharge circuits 108, which are included in the dot circuits 1 through n constituting the light-emitting circuit, by outputting the control signals. The source IC 73 initializes a variable k indicating the dot circuit number to zero (Step S1001).

When a main scanning period starts (Step S1002: YES), the source IC 73 switches on (to conductive) the respective interrupt switches 102 included in the dot circuits 1 through n so as to supply a drive current to the respective organic EL elements 101 included in the dot circuits 1 through n (Step S1003). The source IC 73 increments the variable k, which indicates the dot circuit number, by one (Step S1004). Then, the source IC 73 switches on (to conductive) the DAC connection switch 107 included in the dot circuit k by outputting the control signal SELck to control the DAC 74 to apply the first voltage to the first holding element 106 included in the dot circuit k, and controls the first holding element 106 to hold therein a voltage difference between the first reference voltage and the applied first voltage (Step S1005).

Next, the source IC 73 switches off (to non-conductive) the DAC connection switch 107 included in the dot circuit k by outputting the control signal SELck (Step S1006). Then, the source IC 73 repeats performing the processing in Steps S1004 to S1006 until the variable k reaches n (Step S1007: YES).

As a result, the source IC 73 sequentially switches a dot circuit with respect to which the sample period (Ts) starts between the dot circuits 1 through n, as shown in FIG. 11. Specifically, the source IC 73 sequentially (in ascending order of dot circuit number) switches on (to conductive) the respective DAC connection switches 107 included in the dot circuits 1 through n by sequentially outputting the control signals SELc1 through SELcn. In synchronization with respective timings when the respective DAC connection switches 107 included in the dot circuits 1 through n are sequentially switched on, the first voltages Vb1 through Vbn are sequentially applied from the DAC 74 to the first holding elements 106-1 through **106-*n*, respectively, and the voltage difference between the first reference voltage and each of the applied voltages Vb1 through Vbn is sequentially held in a corresponding one of the first holding elements 106-1 through 106-*n*. The first hold period (Th) sequentially starts with respect to the dot circuits 1 through n (in FIG. 11**, the voltage difference held in each of the first holding elements is represented by the same reference sign as the first voltage for convenience of representation).

Returning to FIG. 10, the source IC 73 switches off (to non-conductive) the respective interrupt switches 102 included in the dot circuits 1 through n by outputting the control signal SELa so as to temporarily suspend supply of the drive current to the respective organic EL elements 101 included in the dot circuits 1 through n (Step S1008). Then, the source IC 73 switches on (to conductive) the respective selector switches 1081 of the respective discharge circuits 108 included in the dot circuits 1 through n by outputting the control signal reset (Step S1009). The source IC 73 discharges the charge held in the respective second holding elements 104 included in the dot circuits 1 through n until a predetermined discharge period has elapsed (Step S1010).

In this way, when the respective selector switches 1081 of the respective discharge circuits 108 included in the dot circuits 1 through n are switched on (to conductive), the discharge period (Tr) starts as shown in FIG. 11. In this discharge period (Tr), the charge corresponding to the voltage difference between the second reference voltage and the second voltage, which have been held in the second holding elements 104-1 through **104-*n* in the charge period of an immediately previous main scanning period (Hsync), is discharged. Specific description is given below. The source IC 73 controls the respective interrupt switches 102 included in the dot circuits 1 through n to be on (conductive) until the discharge period (Tr) starts. Accordingly, a drive current according to the second voltage difference is supplied to the organic EL elements 101-1 through 101-*n* while the organic EL elements 101-1 through 101-*n* are turned on. As a result, the first holding operation is performed with respect to each of the dot circuits 1 through n in which the voltage difference between the first reference voltage and a corresponding one of the first voltages Vb1 through Vbn is held while the organic EL elements 101-1 through 101-*n*** are turned on.

Returning to FIG. 10, the source IC 73 switches off (to non-conductive) the respective selector switches 1081 of the respective discharge circuits 108 included in the dot circuits 1 through n by outputting the control signal reset (Step S1011). The source IC 73 switches on (to conductive) the respective holding element connection switches 105 included in the dot circuits 1 through n by outputting the control signal SELb so as to electrically connect the first holding elements 106 with the second holding elements 104 in one-to-one correspondence (Step S1012). Until a predetermined charge period has elapsed (Step S1013: YES), the source IC 73 maintains this electric connection, and controls the second holding element 104 to hold therein the voltage difference between the second reference voltage and the second voltage according to the first voltage output to the first holding element 106.

As a result, as shown in FIG. 11, after the first hold period (Th) ends, the voltage difference between the second reference voltage and each of the second voltages Val through Van is simultaneously held in a corresponding one of the second holding elements 104-1 through **104-*n*. Then, a second hold period (Th') starts (in FIG. 11, the voltage difference held in each of the second holding elements is represented by the same reference sign as the second voltage for convenience of representation). Also, until the discharge period (Tr) and the charge period (Tc) have elapsed, the organic EL elements 101 are in the non-emission period (Td) in which the organic EL elements 101** are temporarily turned off.

Returning to FIG. 10, the source IC 73 switches off (to non-conductive) the respective the holding element connection switches 105 included in the dot circuits 1 through n by outputting the control signal SELb so as to electrically disconnect the first holding elements 106 from the second holding elements 104 in one-to-one correspondence (Step S1014). The source IC 73 switches on (to conductive) the respective interrupt switches 102 included in the dot circuits 1 through n by outputting the control signal SELa so as to start supply of a drive current according to the voltage difference between the second reference voltage and the second voltage held in each of the second holding elements 104 to a corresponding one of the organic EL elements 101 in one-to-one correspondence (Step S1015). Then, the source IC 73 proceeds to the processing in Step S1002.

As a result, as shown in FIG. 11, the sample period (Ts) starts again with respect to the dot circuit 1. Also, a drive current according to the voltage difference between the second reference voltage and each of the second voltages Val through Van held in the second holding elements 104-1 through **104-*n* is supplied to a corresponding one of the organic EL elements 101-1 through 101-*n*. As a result, an emission period (Te) starts with respect to the organic EL elements 101-1 through 101-*n* in which the organic EL elements 101-1 through 101-*n*** are turned on.

As described above, the optical PH 13 relating to the present embodiment separately includes the first holding elements 106 which are each for holding the voltage difference between the first reference voltage and the first voltage and the second holding elements 104 which are each for holding the voltage difference between the second reference voltage and the second voltage for use in control of the drive current amount to be supplied to the organic EL elements 101. The first holding elements 106 and the second holding elements 104 are each supplied with the reference voltage from a different power line (from the power lines 92 and 91, respectively). Accordingly, even while the organic EL elements 101 are turned on, it is possible to hold the voltage difference between the first reference voltage and the first voltage in the first holding element 106 with no influence exercised by a potential drop on the power line 91 due to the drive current flowing through the organic EL element 101. Furthermore, since it is possible to continuously turn on the organic EL elements 101 during the sample period with respect to all the dot circuits, thereby increasing the emission period (Te).

Moreover, during temporary suspension of supply of a drive current to the organic EL elements 101, the second holding operation is performed simultaneously with respect to all the dot circuits in which while each of the first holding element 106 is electrically connected with a corresponding one of the second holding element 104, the voltage difference between the second reference voltage and the second voltage according to the first voltage is held in the second holding element 104. Accordingly, it is possible to complete the second holding operation in a short period with no potential drop on the power line 91, with which the second holding element 104 is electrically connected. This reduces a non-emission period (Td) of the organic EL element 101, thereby increasing the emission period (Te).

As a result, it is possible to increase the light emission duty ratio while suppressing unevenness in light emission amount between the organic EL elements 101 due to the potential drop on the power line.

(Modification)

Although the present invention has been explained based on the above embodiment, the present invention is not of course limited to the above embodiment. The present invention may include the following modifications.

Figure 12:
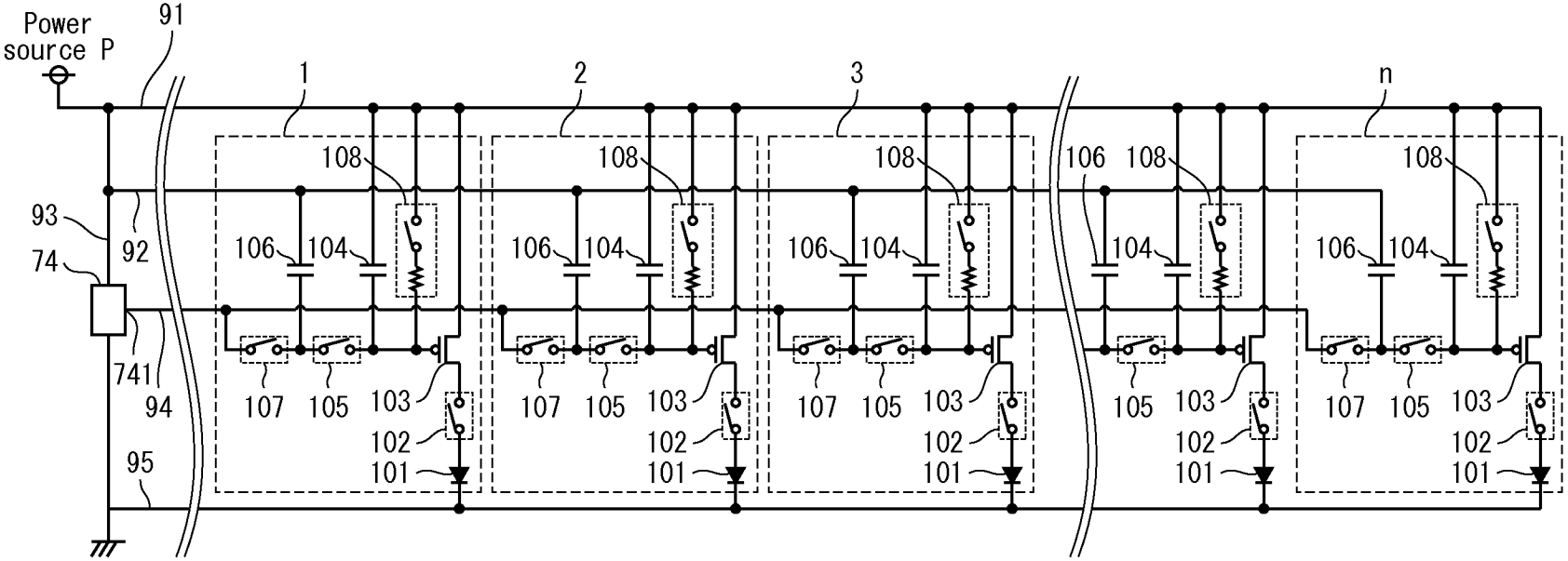
FIG. 12 shows a modification of the circuit configuration shown in FIG. 5.
Figure 13:
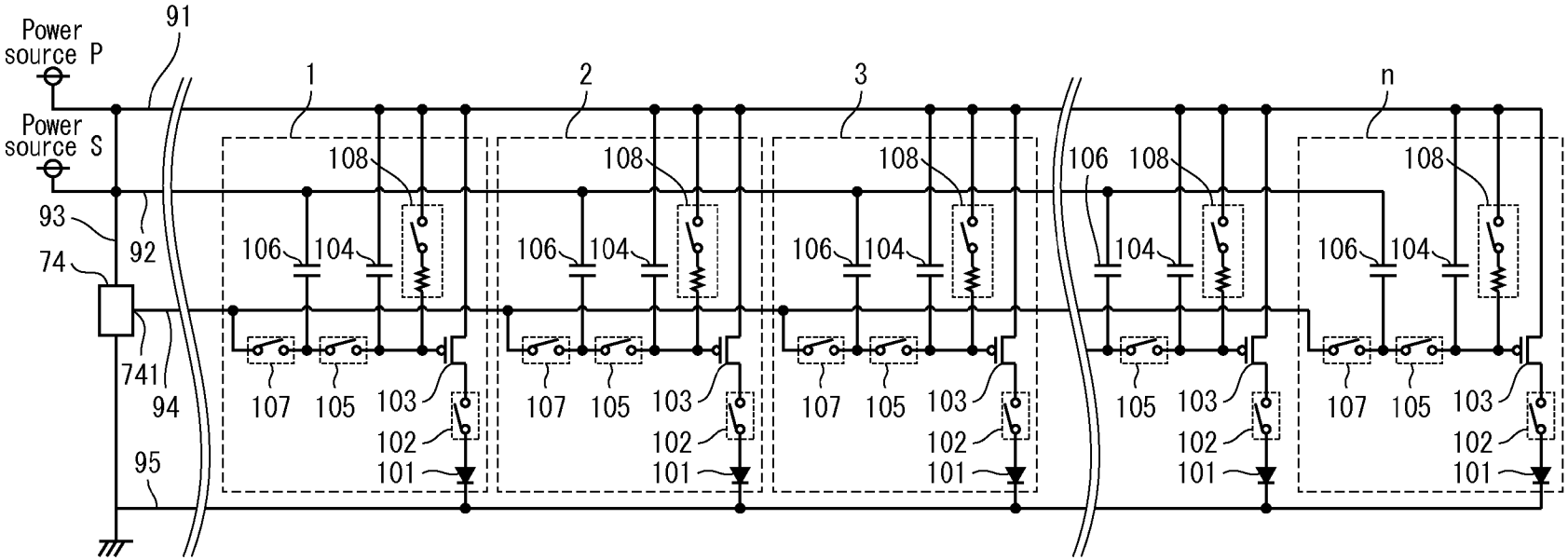
FIG. 13 shows another modification of the circuit configuration shown in FIG. 5.

(1) In the present embodiment, the power line 91, which supplies the second reference voltage, is disconnected from the power line 92, which supplies the first reference voltage. Alternatively, as shown in FIG. 12 and FIG. 13, the power lines 91 and 92 may be connected with each other on the side closer to the power source than the first holding element 106. With this configuration, uniform voltage is input to the TFT substrate 71 on which the light-emitting circuits are formed. This simplifies the wiring configuration of the power source, thereby reducing the manufacturing cost.

(2) In the above embodiment, the interrupt switches 102 are each arranged on the circuit that is configured starting with the corresponding drive circuit 103 to reach the corresponding organic EL element 101. Alternatively, the interrupt switch 102 only needs to be arranged on a circuit that is configured starting with a connection point between the driving circuit 103 and the power line 91 to reach the organic EL element 101. The disposition of the interrupt switch 102 is not limited to that shown in the embodiment.

In the case where the interrupt switch 102 is arranged on the circuit, which is configured starting with the connection point to reach the drive circuit 103, on the other hand, the precision of the drive current amount to be supplied to the organic EL element 101 might decrease because the gate voltage of the driving circuit 103 sometimes varies depending on unevenness in current conducting properties of the interrupt switch 102. Therefore, the interrupt switch 102 should be desirably disposed as shown in the embodiment in order to suppress the unevenness in drive current amount.

(3) In the above embodiment, the voltage difference between the second reference voltage and the second voltage for controlling the drive current amount is held in each of the second holding elements 104 by the electrical charge moving from the corresponding first holding element 106 to the second holding element 104. Accordingly, it is possible to decrease the first voltage, which is necessary for holding the above voltage difference in the second holding element 104, by controlling the electrostatic capacitance Cb of the first holding element 106 to be larger than the electrostatic capacitance Ca of the second holding element 104. This reduces an amplitude of a voltage signal.

Accordingly, the optical PH 13 may have the configuration such that the electrostatic capacitance Cb of the first holding element 106 and the electrostatic capacitance Ca of the second holding element 104 satisfy Cb>Ca.

(4) In the above embodiment, the organic EL elements are used as light-emitting elements. Alternatively, the light-emitting elements to which the above embodiment is applicable only needs to be current-driven light-emitting elements, and are not limited to be organic EL elements. The light-emitting elements may be LEDs for example.

(5) In the above embodiment, the explanation has been given with use of an example where the optical PH is a tandem-type color printer. However, the present invention is not limited to this. The optical PH may be applied to for example color printers that are not of a tandem-type or monochrome printers.

Alternatively, the optical PH may be applied to image forming apparatuses including a photoreceptor such as copiers, facsimile devices, and multiple function peripherals (MFPs). Furthermore, the optical PH may be applied to general devices that perform writing onto a photoreceptor by an optical beam, without limiting to image forming apparatuses.

SUMMARY

An optical print head relating to one aspect of the present invention disclosed above comprises: a plurality of current-driven light-emitting elements that are disposed in a line shape; a first power line that supplies a first reference voltage; a second power line that supplies a drive current to each of the light-emitting elements, and supplies a second reference voltage; a first voltage output unit that outputs, with respect to each of the light-emitting elements, a first voltage indicating a light emission amount of the light-emitting element; a plurality of first holding elements that are provided in one-to-one correspondence with the light-emitting elements, and are each for holding therein a first voltage difference between the first reference voltage and the first voltage; a plurality of second holding elements that are provided in one-to-one correspondence with the light-emitting elements, are each electrically connectable with a corresponding one of the first holding elements, and are each for holding therein a second voltage difference between the second reference voltage and a second voltage, the second voltage being according to the first voltage; and a control unit that successively performs a first holding operation and a second holding operation in a main scanning period, wherein the first holding operation is an operation that, during supply of the drive current to each of the light-emitting elements, with respect to each of the light-emitting elements, controls a corresponding one of the first holding elements to hold therein the first voltage difference by electrically disconnecting the corresponding first holding element from a corresponding one of the second holding elements, and the second holding operation is an operation that temporarily suspends supply of the drive current to the light-emitting element, and controls the second holding element to hold therein the second voltage difference by electrically connecting the first holding element with the second holding element, such that the drive current according to the second voltage difference is supplied to the light-emitting element after supply of the drive current is resumed.

Here, during temporary suspension of supply of the drive current, the control unit may electrically connect the first holding element with the second holding element after discharging a charge corresponding to the second voltage difference held in the second holding element.

Also, the optical print head may further comprise a plurality of interrupt units that are provided in one-to-one correspondence with the light-emitting elements, and are each for interrupting supply of the drive current to a corresponding one of the light-emitting elements, wherein the control unit may temporarily suspend supply of the drive current to each of the light-emitting elements by controlling the interrupt units to simultaneously interrupt supply of the drive current.

Also, the optical print head may further comprise a plurality of drive units that are provided in one-to-one correspondence with the light-emitting elements, and are each arranged on a circuit that is configured starting with the second power line to reach a corresponding one of the light-emitting elements, the drive units each controlling an amount of the drive current to be supplied to the corresponding light-emitting element, wherein the interrupt units may each interrupt supply of the drive current by electrically disconnecting a corresponding one of the light-emitting elements from a corresponding one of the drive units.

Also, the first power line and the second power line may each extend from a different power source. Alternatively, the first power line and the second power line may extend from a common power source.

Also, the first holding elements may each have a larger electrostatic capacitance than a corresponding one of the second holding elements has. Also, the light-emitting elements may be each an organic EL element.

Also, the first power line may extend along the light-emitting elements, and the second power line may extend along the first power line. Also, the main scanning period may be a period from when the first holding operation starts to when the second holding operation completes.

Also, an image forming apparatus relating to one aspect of the present invention may comprise the optical print head.

With the above configuration, the first holding elements, which are each for holding therein the voltage difference between the first reference voltage and the first voltage indicating the light emission amount, and the second holding elements, which are each for holding therein the voltage difference between the second reference voltage and the second voltage according to the first voltage, are provided separately. Also, the first reference voltage and the second reference voltage are supplied to the first holding element and the second holding element, respectively from a different power line. Accordingly, even while the drive current is supplied to the light-emitting elements from the second power line and thereby the light-emitting elements are turned on, it is possible to hold the voltage difference between the first reference voltage and the first voltage in each of the first holding elements with no influence exercised by a potential drop on the second power line due to the drive current flowing through the light-emitting elements.

Furthermore, during a period for holding the voltage difference between the first reference voltage and the first voltage, it is possible to supply the drive current to the light-emitting elements from the second power line to continuously turn on the light-emitting elements. This increases a light emission period in each of the main scanning periods.

Also, during temporary suspension of supply of the drive current to the light-emitting elements from the second power line, the second holding operation is performed in which the voltage difference between the second reference voltage and the second voltage is held in the second holding element by electrically connecting the first holding element, which holds therein the voltage difference between the first reference voltage and the first voltage and the second holding element. Accordingly, it is possible to complete the second holding operation with no potential drop on the second power line.

As a result, it is possible to increase the light emission duty ratio while suppressing unevenness in light emission amount between the light-emitting elements due to the potential drop on the second power line.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An optical print head comprising:

a plurality of current-driven light-emitting elements that are disposed in a line shape;

an earth line;

a first power line that is different from the earth line and supplies a first reference voltage;

a second power line that supplies a drive current to each of the light-emitting elements, and supplies a second reference voltage;

a first voltage output unit that outputs, with respect to each of the light-emitting elements, a first voltage indicating a light emission amount of the light-emitting element;

a plurality of first holding elements that are provided in one-to-one correspondence with the light-emitting elements, and are each for holding therein a first voltage difference between the first reference voltage and the first voltage;

a plurality of second holding elements that are provided in one-to-one correspondence with the light-emitting elements, are each electrically connectable with a corresponding one of the first holding elements, and are each for holding therein a second voltage difference between the second reference voltage and a second voltage, the second voltage being according to the first voltage; and a control unit that successively performs a first holding operation and a second holding operation in a main scanning period, wherein the first holding operation is an operation that, during supply of the drive current to each of the light-emitting elements, with respect to each of the light-emitting elements, controls a corresponding one of the first holding elements to hold therein the first voltage difference by electrically disconnecting the corresponding first holding element from a corresponding one of the second holding elements, and the second holding operation is an operation that temporarily suspends supply of the drive current to the light-emitting element, and controls the second holding element to hold therein the second voltage difference by electrically connecting the first holding element with the second holding element, such that the drive current according to the second voltage difference is supplied to the light-emitting element after supply of the drive current is resumed.

2. The optical print head of claim 1, wherein during temporary suspension of supply of the drive current, the control unit electrically connects the first holding element with the second holding element after discharging a charge corresponding to the second voltage difference held in the second holding element.

3. The optical print head of claim 1, further comprising a plurality of interrupt units that are provided in one-to-one correspondence with the light-emitting elements, and are each for interrupting supply of the drive current to a corresponding one of the light-emitting elements, wherein the control unit temporarily suspends supply of the drive current to each of the light-emitting elements by controlling the interrupt units to simultaneously interrupt supply of the drive current.

4. The optical print head of claim 3, further comprising a plurality of drive units that are provided in one-to-one correspondence with the light-emitting elements, and are each arranged on a circuit that is configured starting with the second power line to reach a corresponding one of the light-emitting elements, the drive units each controlling an amount of the drive current to be supplied to the corresponding light-emitting element, wherein the interrupt units each interrupt supply of the drive current by electrically disconnecting a corresponding one of the light-emitting elements from a corresponding one of the drive units.

5. The optical print head of claim 1, wherein the first power line and the second power line each extend from a different power source.

6. The optical print head of claim 1, wherein the first power line and the second power line extend from a common power source.

7. The optical print head of claim 1, wherein the first holding elements each have a larger electrostatic capacitance than a corresponding one of the second holding elements has.

8. The optical print head of claim 1, wherein the light-emitting elements are each an organic EL element.

9. The optical print head of claim 1, wherein the first power line extends along the light-emitting elements, and the second power line extends along the first power line.

10. The optical print head of claim 1, wherein the main scanning period is a period from when the first holding operation starts to when the second holding operation completes.

11. An image forming apparatus comprising an optical print head, the optical print head comprising:

a plurality of current-driven light-emitting elements that are disposed in a line shape;

an earth line;

a first power line that is different from the earth line and supplies a first reference voltage;

a second power line that supplies a drive current to each of the light-emitting elements, and supplies a second reference voltage;

a first voltage output unit that outputs, with respect to each of the light-emitting elements, a first voltage indicating a light emission amount of the light-emitting element;

a plurality of first holding elements that are provided in one-to-one correspondence with the light-emitting elements, and are each for holding therein a first voltage difference between the first reference voltage and the first voltage;

a plurality of second holding elements that are provided in one-to-one correspondence with the light-emitting elements, are each electrically connectable with a corresponding one of the first holding elements, and are each for holding therein a second voltage difference between the second reference voltage and a second voltage, the second voltage being according to the first voltage; and a control unit that successively performs a first holding operation and a second holding operation in a main scanning period, wherein the first holding operation is an operation that, during supply of the drive current to each of the light-emitting elements, with respect to each of the light-emitting elements, controls a corresponding one of the first holding elements to hold therein the first voltage difference by electrically disconnecting the corresponding first holding element from a corresponding one of the second holding elements, and the second holding operation is an operation that temporarily suspends supply of the drive current to the light-emitting element, and controls the second holding element to hold therein the second voltage difference by electrically connecting the first holding element with the second holding element, such that the drive current according to the second voltage difference is supplied to the light-emitting element after supply of the drive current is resumed.

12. The optical print head of claim 1, wherein the first reference voltage is different in value from the second reference voltage.

13. The image forming apparatus of claim 11, wherein the first reference voltage is different in value from the second reference voltage.

14. The image forming apparatus of claim 11, wherein during temporary suspension of supply of the drive current, the control unit electrically connects the first holding element with the second holding element after discharging a charge corresponding to the second voltage difference held in the second holding element.

* * * * *